US010022972B2

(12) United States Patent
Shimazu

(10) Patent No.: US 10,022,972 B2
(45) Date of Patent: Jul. 17, 2018

(54) WASTE LIQUID CONTAINER AND ATTACHMENT

(71) Applicant: Seiko Epson Corporation, Tokyo (JP)

(72) Inventor: Masamitsu Shimazu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 15/399,126

(22) Filed: Jan. 5, 2017

(65) Prior Publication Data

US 2017/0203575 A1 Jul. 20, 2017

(30) Foreign Application Priority Data

Jan. 14, 2016 (JP) ..... 2016-005017

(51) Int. Cl.
*B41J 2/17* (2006.01)

(52) U.S. Cl.
CPC ..... *B41J 2/1721* (2013.01)

(58) Field of Classification Search
CPC ..... B41J 2/1721
See application file for complete search history.

(56) References Cited

U.S. PATENT DOCUMENTS

| | | | |
|---|---|---|---|
| 8,807,703 | B2 | 8/2014 | Okamoto et al. |
| 2012/0218348 | A1 | 8/2012 | Okamoto et al. |
| 2015/0314605 | A1 | 11/2015 | Hirasawa et al. |
| 2015/0375509 | A1 | 12/2015 | Harada et al. |

FOREIGN PATENT DOCUMENTS

| | | | |
|---|---|---|---|
| JP | 2009-269209 | A | 11/2009 |
| JP | 2010-260261 | A | 11/2010 |
| JP | 2015-208991 | A | 11/2015 |
| JP | 5831678 | B2 | 11/2015 |
| JP | 2015208991 | A * | 11/2015 |

OTHER PUBLICATIONS

European Search Report issued in Application No. 17151381 dated Sep. 26, 2017.

* cited by examiner

*Primary Examiner* — Sharon A Polk
(74) *Attorney, Agent, or Firm* — Workman Nydegger

(57) ABSTRACT

A waste liquid container includes an accommodating case which includes a mounting surface which is an external surface that faces internally in a mounting direction and a first side surface and a second side surface which are outside surfaces extending in a direction intersecting a width direction, a waste liquid introducing portion which is connected to a discharging portion, and a circuit board including a connecting terminal which is electrically connected to a substrate connecting portion. The accommodating case includes a recessed portion which opens on the mounting surface and the first side surface and allows a projecting portion to be inserted therein, when being mounted on the mounting portion, and a notch which opens on the mounting surface and the second side surface vertically below the waste liquid introducing portion. The connecting terminal is disposed inside the recessed portion.

6 Claims, 12 Drawing Sheets

WASTE LIQUID CONTAINER AND ATTACHMENT

BACKGROUND

1. Technical Field

The present invention relates to a waste liquid container for containing waste liquid such as waste ink and to an attachment used for recovering the waste liquid.

2. Related Art

An ink jet type printer, which is an example of a liquid ejecting apparatus, discharges ink as waste liquid from a liquid ejecting head in order to resolve clogging of the liquid ejecting head, or the like, and in such a printer, a waste liquid container (waste liquid recovery member) for containing the discharged waste liquid is mounted. Also, in the waste liquid container, a circuit board which stores information relating to the amount of liquid contained, or the like, is mounted, and transmitting and receiving of the stored information to and from the printer at the time of being mounted are performed (for example, JP-A-2009-269209).

In such a waste liquid container, in a case in which the waste liquid leaks from a part connected to the printer, the waste liquid may adhere to a connecting terminal of the circuit board such that a contact failure occurs, and there may thus be a problem that transmitting and receiving of the information are less likely to be performed.

Also, such a problem is not limited to a waste liquid container mounted in an ink jet type printer which ejects ink and is generally common to a waste liquid container and an attachment which are mounted on a mounting portion including a circuit board.

SUMMARY

An advantage of some aspects of the invention is to provide a waste liquid container and an attachment which are capable of suppressing waste liquid from adhering to a connecting terminal of a circuit board.

Hereinafter, means of the invention and operation effects thereof will be described.

According to an aspect of the invention, there is provided a waste liquid container which is detachably mounted by moving in a mounting direction intersecting a gravity direction, with respect to a mounting portion including a projecting portion, in which a substrate connecting portion is mounted, and a discharging portion, which discharges waste liquid, the waste liquid container including an accommodating case that includes a mounting surface which is an external surface that faces internally in the mounting direction and a first side surface and a second side surface which are outside surfaces extending in a direction intersecting a width direction, when a direction intersecting both the gravity direction and the mounting direction is set to the width direction, a waste liquid introducing portion that is connected to the discharging portion at the time of being mounted on the mounting portion, and a circuit board that includes a connecting terminal which is electrically connected to the substrate connecting portion at the time of being mounted on the mounting portion, in which the accommodating case includes a recessed portion which opens on the mounting surface and the first side surface and allows the projecting portion to be inserted therein, when being mounted on the mounting portion, and a notch which opens on the mounting surface and the second side surface vertically below the waste liquid introducing portion, and the connecting terminal is disposed inside the recessed portion.

According to this configuration, since the connecting terminal of the waste liquid container is disposed inside the recessed portion which opens in a direction intersecting the gravity direction, it is difficult for waste liquid, which adheres and drips further than the connecting terminal disposed at a position where an upper side opens, to adhere to the connecting terminal and for waste liquid, which drips lower than the connecting terminal disposed at a position where a lower side opens, to adhere to the connecting terminal. Further, in the accommodating case, since the notch which opens on the mounting surface and the second side surface is provided vertically below the waste liquid introducing portion, the waste liquid, which leaks from the waste liquid introducing portion and flows and drips on the mounting surface, flows to the notch side. Also, the recessed portion and the notch open on an outside surface of an opposite side in the width direction, and the waste liquid flowing to the notch is less likely to flow into the recessed portion. Therefore, when the notch is disposed lower than the waste liquid introducing portion and the leaked waste liquid is guided to the notch side, the waste liquid can be suppressed from adhering to the connecting terminal of the circuit board inside the recessed portion.

In the waste liquid container, the circuit board may be mounted in the accommodating case so that the connecting terminal is disposed toward the outside in the width direction in the recessed portion.

According to this configuration, since the circuit board is mounted in the accommodating case so that the connecting terminal is disposed toward the outside in the width direction inside the recessed portion, the dripping waste liquid can be better suppressed from adhering to the connecting terminal than in a case in which the circuit board is disposed so that the connecting terminal faces upward. In addition, the dripping waste liquid can be better suppressed from adhering to the connecting terminal than in a case in which the circuit board is disposed so that the connecting terminal is face downward.

In the waste liquid container, the waste liquid container may be removed from the mounting portion by moving the waste liquid container in a unmounting direction which is a direction opposite to the mounting direction, and the notch may extend from the mounting surface in the unmounting direction.

According to this configuration, the notch extends in the unmounting direction from the mounting surface, and the waste liquid dripping from the mounting surface is guided so as to flow along the notch in the unmounting direction. Accordingly, the flows out from the notch in a downward direction and the waste liquid can be suppressed from flowing into the recessed portion by flowing along a bottom portion of the accommodating case.

In the waste liquid container, the recessed portion may be provided between a reference position and the first side surface in the width direction, and the notch may be provided between the reference position and the second side surface in the accommodating case.

According to this configuration, in the accommodating case, since the recessed portion is provided on one side in the width direction and the notch is provided on the other side, which is on an opposite side thereto, the waste liquid flowing out from the notch is less likely to flow into the recessed portion compared with a case in which the recessed portion is disposed below the notch. Therefore, the waste liquid can be suppressed from adhering to the connecting terminal of the circuit board inside the recessed portion.

In the waste liquid container, the notch may be provided right below the waste liquid introducing portion in the accommodating case.

According to this configuration, in the accommodating case, since the notch is provided right below the waste liquid introducing portion, the waste liquid adhering and dripping from the waste liquid introducing portion can be naturally guided to the notch side.

According to another aspect of the invention, there is provided an attachment which is mounted by moving in a mounting direction intersecting a gravity direction, with respect to a mounting portion including a projecting portion, in which a substrate connecting portion is mounted, and a discharging portion, which discharges waste liquid, the attachment including an accommodating case that includes a mounting surface which is an external surface that faces internally in the mounting direction and a first side surface and a second side surface which are outside surfaces extending in a direction intersecting a width direction, when a direction intersecting both the gravity direction and the mounting direction is set to the width direction, a waste liquid introducing portion that is connected to the discharging portion at the time of being mounted on the mounting portion, and a circuit board that includes a connecting terminal which is electrically connected to the substrate connecting portion at the time of being mounted on the mounting portion, in which the accommodating case includes a recessed portion which opens on the mounting surface and the first side surface and allows the projecting portion to be inserted therein, when being mounted on the mounting portion, and a notch which opens on the mounting surface and the second side surface vertically below the waste liquid introducing portion, and the connecting terminal is disposed inside the recessed portion.

According to this configuration, operational effects the same as those in the waste liquid container can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with respect to the drawings. The liquid ejecting apparatus is, for example, an ink jet type printer which performs recording (printing) by ejecting ink, which is an example of a liquid, onto a medium such as paper.

Figure 1:
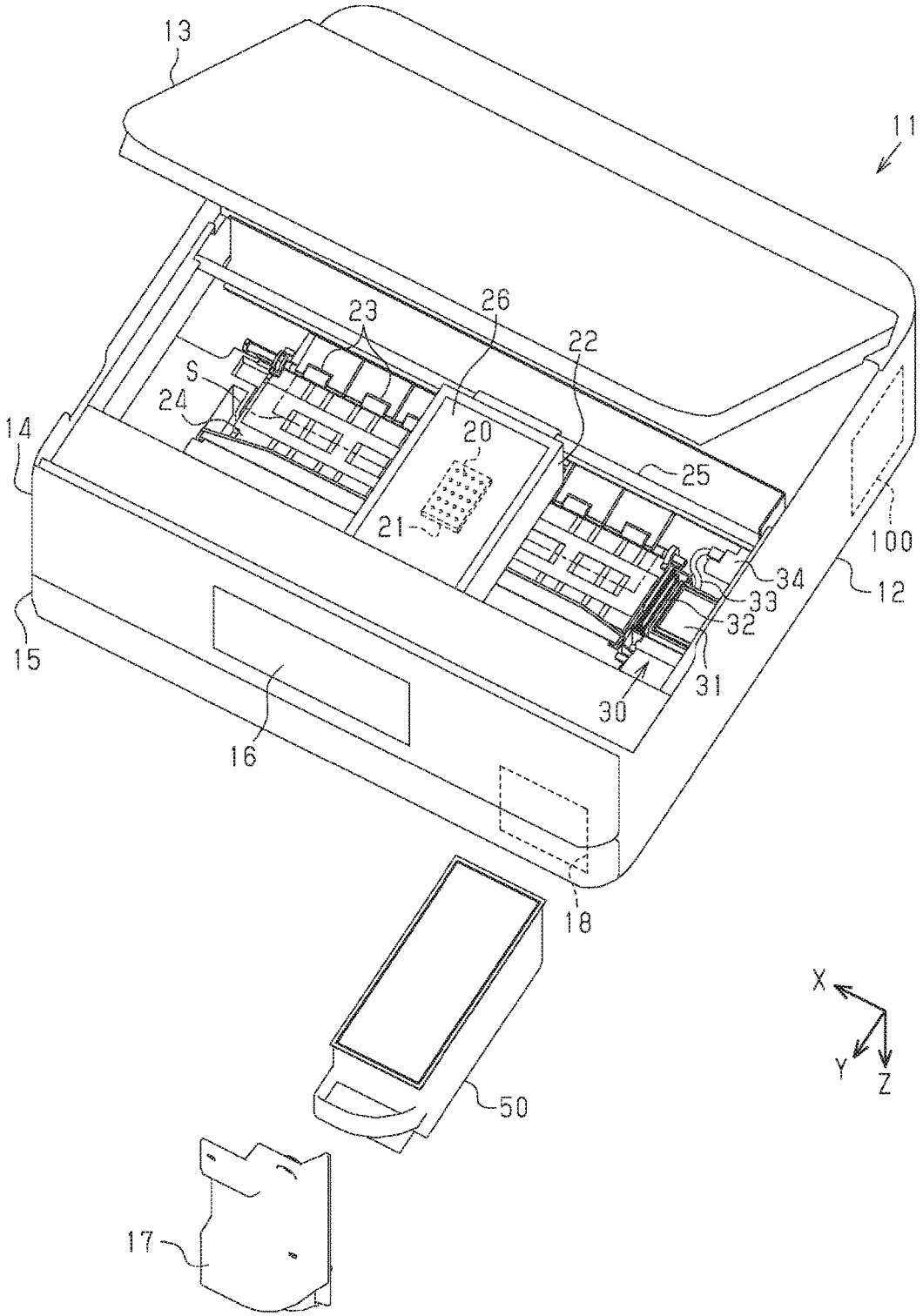
FIG. 1 is a perspective view of a liquid ejecting apparatus in which a waste liquid container of an embodiment is mounted.
Figure 2:
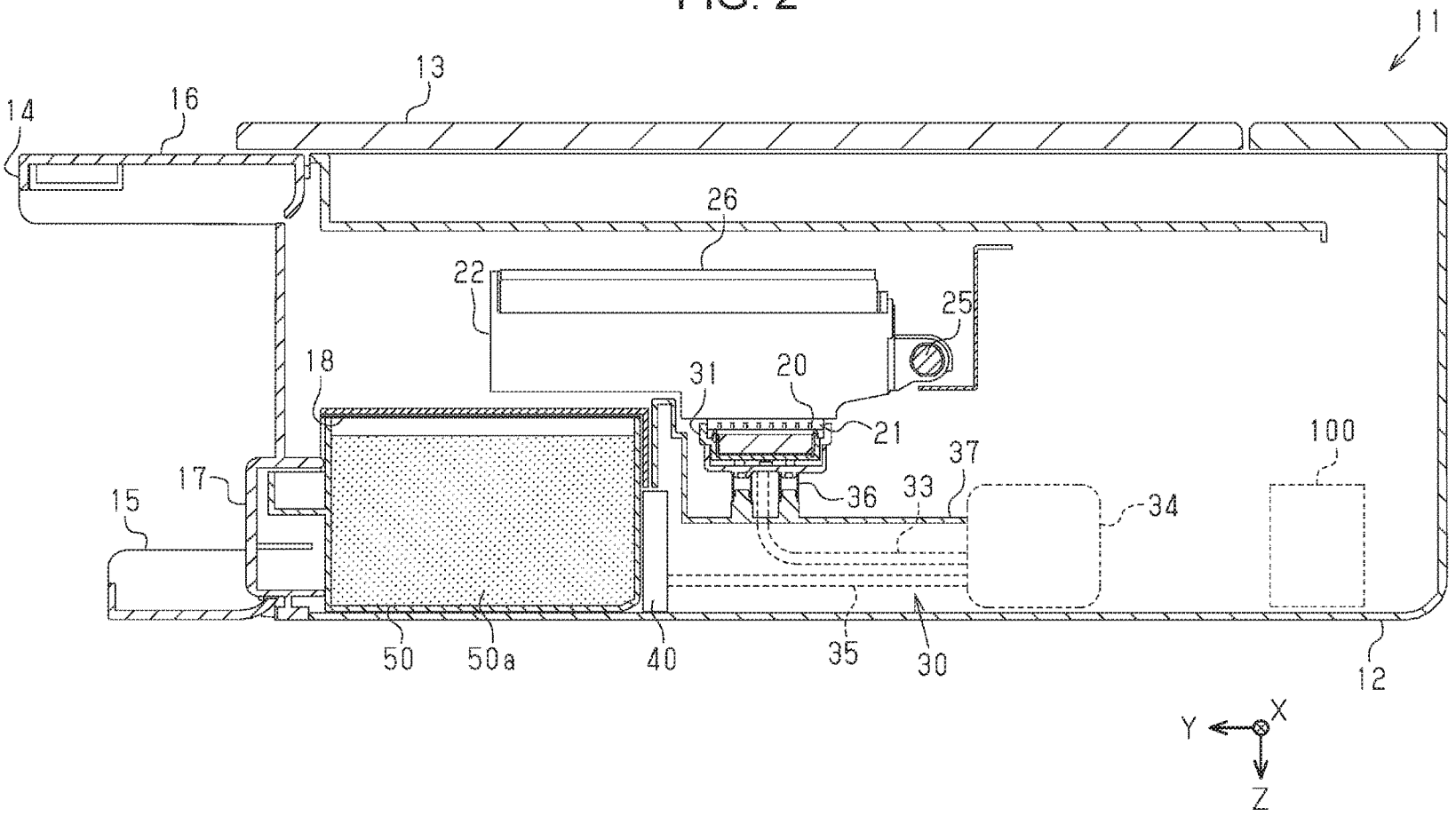
FIG. 2 is a sectional view of the liquid ejecting apparatus in FIG. 1.

As illustrated in FIG. 1 and FIG. 2, the liquid ejecting apparatus 11 is provided with a rectangular case 12, an opening and closing lid 13 which is mounted to be rotatable with respect to the case 12, an opening and closing panel 14, and an opening and closing cover 15. When a side in which the opening and closing lid 13 is mounted is set to a top side of the case 12 and a side in which a rotation shaft of the opening and closing lid 13 is disposed is set to a rear side of the case 12, the opening and closing lid 13 is disposed in a position like the opening position illustrated in FIG. 1 and the closed position illustrated in FIG. 2 by being rotated by a predetermined angle around a rear end of the closing lid 13.

Inside the case 12, a liquid ejecting head 21 including a plurality of nozzles 20 which are capable of ejecting liquid, a carriage 22 which reciprocates while holding the liquid ejecting head 21, a transporting roller 23 which transports a medium S, a medium supporting portion 24 which is disposed on a transporting path of the medium S, a guide shaft 25, and a maintenance mechanism 30 which performs maintenance of the liquid ejecting head 21 are accommodated. In addition, the liquid ejecting apparatus 11 is provided with a controller 100, which controls an operation of a configuration component including the liquid ejecting head 21 and the maintenance mechanism 30, at a predetermined position inside the case 12.

The guide shaft 25 extends in a moving direction X intersecting ("orthogonal to" in the embodiment) the gravity direction Z. In addition, in the carriage 22, a liquid container 26 which contains liquid ejected by the liquid ejecting head 21 is detachably mounted.

The liquid ejecting head 21 reciprocates in the moving direction X under control of the controller 100 while held by the carriage 22. In addition, the transporting roller 23 transports the medium S onto the medium supporting portion 24 in a transporting direction Y intersecting ("orthogonal to" in the embodiment) both the gravity direction Z and the moving direction X under control of the controller 100. The liquid ejecting head 21 performs printing (recording) by ejecting liquid supplied from the liquid container 26 onto the medium S supported by the medium supporting portion 24, while reciprocating in the moving direction X, under control of the controller 100.

The medium supporting portion 24 and the maintenance mechanism 30 are disposed parallel to each other in the moving direction X of the liquid ejecting head 21. In addition, the maintenance mechanism 30 includes a cap 31 disposed on one end side of the moving direction X, a wiper 32 for sweeping the liquid ejecting head 21, and a suction pump 34 connected via the cap 31 and a suction tube 33.

In the embodiment, a position where the cap 31 is placed in a moving region of the liquid ejecting head 21 in the moving direction X is referred to as a home position of the liquid ejecting head 21. In addition, a side where the cap 31 is placed in the moving direction X is referred to as a home side, and a side opposite to the home side is referred to as an opposite home side.

The opening and closing panel 14 mounted on a front side of the case 12 is disposed at a closed position illustrated in FIG. 1 and at an opening position illustrated in FIG. 2 by being rotated by approximately 90 degrees with respect to a upper end side. In the opening and closing panel 14, a panel 16, which performs an operation of the liquid ejecting apparatus 11 or displays an operation state, or the like of the liquid ejecting apparatus 11, is disposed.

The opening and closing cover 15, which is mounted on a lower side of the opening and closing panel 14 of a front side of the case 12, is disposed at a closing position illustrated in FIG. 1 and at an opening position illustrated in FIG. 2 by being rotated by approximately 90 degrees with respect to a lower end side.

When the opening and closing panel 14 and the opening and closing cover 15 are disposed at the opening position as illustrated in FIG. 2, a container cover 17, which is mounted to be detachable with respect to the case 12, is exposed. The container cover 17 covers an opening of a mounting chamber 18 in which the waste liquid container 50 is detachably mounted, and the container cover 17 covering the opening has a function of applying a force to the waste liquid container 50 such that the waste liquid container 50 is not detached from the mounting chamber 18. In addition, inside the mounting chamber 18, the mounting portion 40, which is connected to the waste liquid container 50 inserted into the mounting chamber 18, is provided. Also, the container cover 17 may be attached to the case 12 by using a screw, or the like.

The waste liquid container 50 contains liquid which is discharged as waste liquid from the liquid ejecting head 21, and the waste liquid container 50 may accommodate an absorber 50*a* which is capable of absorbing the waste liquid therein. Also, in a case in which the container is filled with the waste liquid, and the like, the waste liquid container 50 may be exchanged for a new waste liquid container by removing the waste liquid container 50 from the mounting chamber 18.

In the embodiment, since the mounting portion 40 is positioned inside the mounting chamber 18 which has an opening facing forward (downstream of transporting direction Y), a direction toward an upstream side of the transporting direction Y is specified as a mounting direction with respect to the mounting portion 40 of the waste liquid container 50, and a direction toward a downstream side of the transporting direction Y is specified as the unmounting direction of the mounting portion 40. That is, the waste liquid container 50 is mounted on the mounting portion 40 by being moved in the mounting direction intersecting the gravity direction Z and is detached from the mounting portion 40 by being moved in the unmounting direction, which is a direction opposite to the mounting direction.

The suction pump 34 constituting the maintenance mechanism 30 is connected to the waste liquid container 50 mounted on the mounting chamber 18 through the discharging tube 35. In addition, the cap 31 is supported by a supporting frame 37 inside the case 12 through an energizing member 36. The cap 31 is configured to be movable to an opening position distant from the liquid ejecting head 21 and to a capping position (position illustrated in FIG. 2) in contact with the liquid ejecting head 21 so as to surround the nozzles 20 in response to an energizing force of the energizing member 36 by a moving mechanism, which is not illustrated.

The maintenance mechanism 30 performs a maintenance operation of the liquid ejecting head 21 in response to control of the controller 100 so that the liquid ejecting head 21 has favorable ejecting characteristics. For example, at the time of power-off when the liquid ejecting head 21 is not ejecting liquid, the liquid ejecting head 21 is disposed at the home position.

The cap 31 is moved to a capping position, and capping for forming a closing space where the nozzles 20 open is performed. Because of the capping, clogging of the nozzles 20 due to drying out is less likely to occur.

The maintenance mechanism 30 drives the suction pump 34 while capping is performed, and suction cleaning for forcedly causing the liquid inside the liquid ejecting head 21 to flow from the nozzles 20 is performed. Also, pressurization cleaning for causing the liquid to flow from the nozzle 20 can be performed by pressurizing the liquid of the liquid ejecting head 21.

In a case in which an ejection failure of the liquid due to clogging of the nozzles 20, or the like occurs, cleaning including suction cleaning and pressurization cleaning may be performed at the time of initial charging when a flow path to the nozzle 20 is filled with liquid, and may be performed, in response to a user operation, as a maintenance operation to address an ejection failure. In addition, cleaning can be periodically performed after a predetermined time has elapsed.

After the cleaning, in a state in which an inside of the cap 31 opens to the atmosphere when the cap 31 is opened to the opening position, or the like, an idling suction for driving the suction pump 34 is performed again, and the waste liquid remaining inside the cap 31 is sucked out. The liquid flowing from the liquid ejecting head 21 as a result of the cleaning and the idling suction is stored in the waste liquid container 50 through the discharging tube 35 and the mounting portion 40 as waste liquid that includes air bubbles, a solute component of thickened liquid, or the like.

Next, a configuration of the mounting portion 40 will be described in detail.

Figure 3:
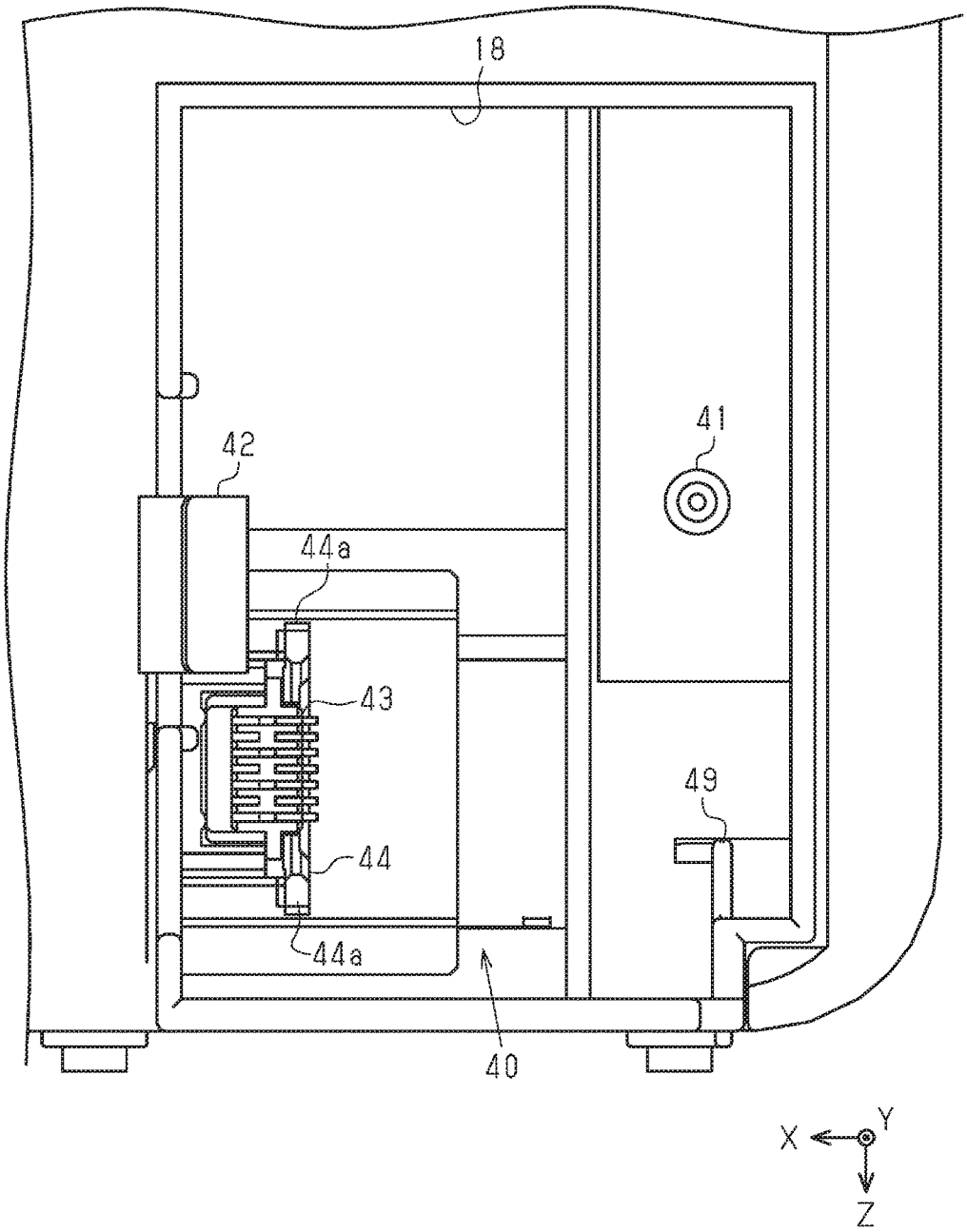
FIG. 3 is a front view illustrating a configuration of a mounting portion included in the liquid ejecting apparatus in FIG. 1.
Figure 4:
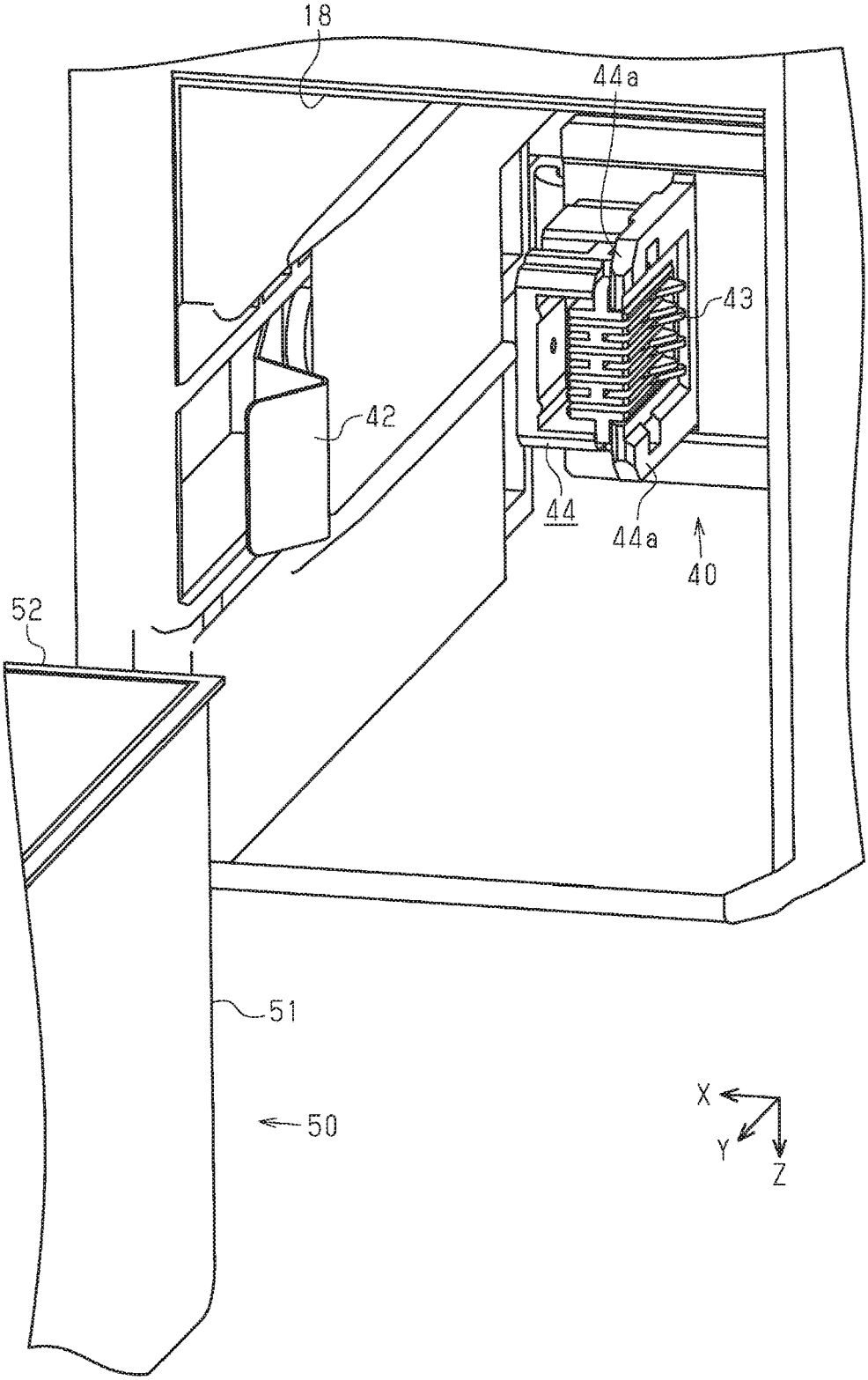
FIG. 4 is a perspective view of the mounting portion in FIG. 3.
Figure 5:
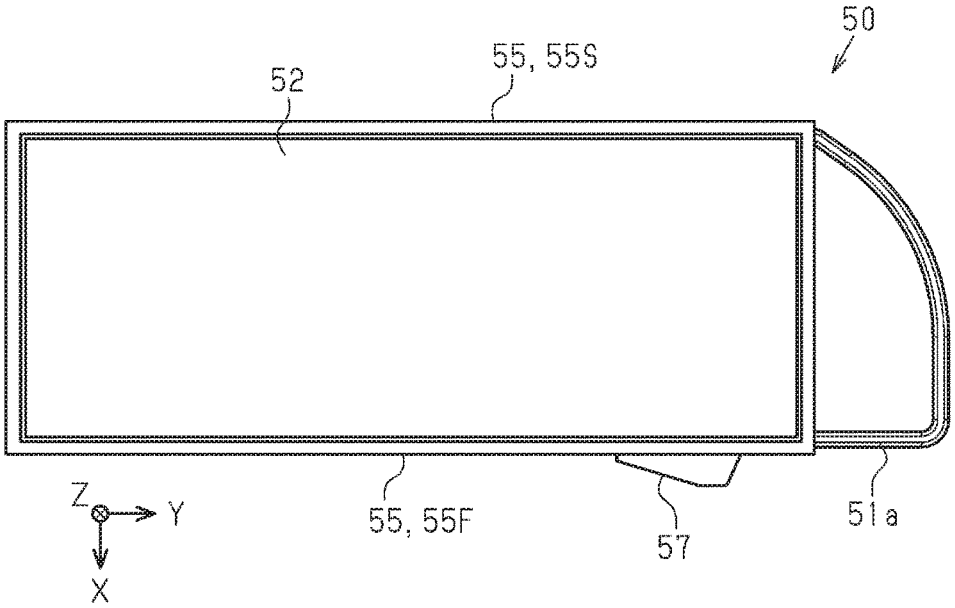
FIG. 5 is a top view of the waste liquid container of the embodiment.
Figure 6:
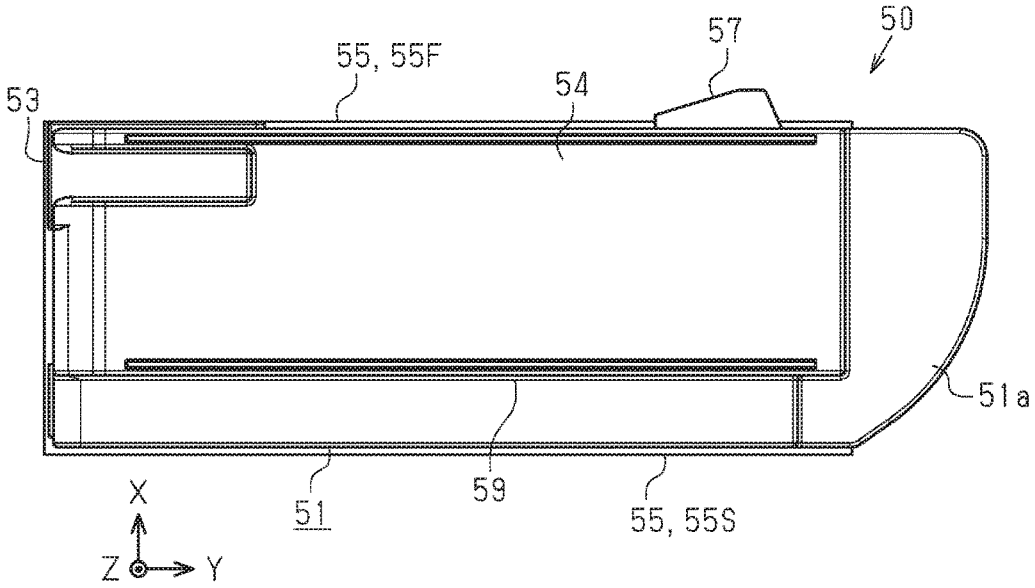
FIG. 6 is a bottom view of the waste liquid container in FIG. 5.
Figure 7:
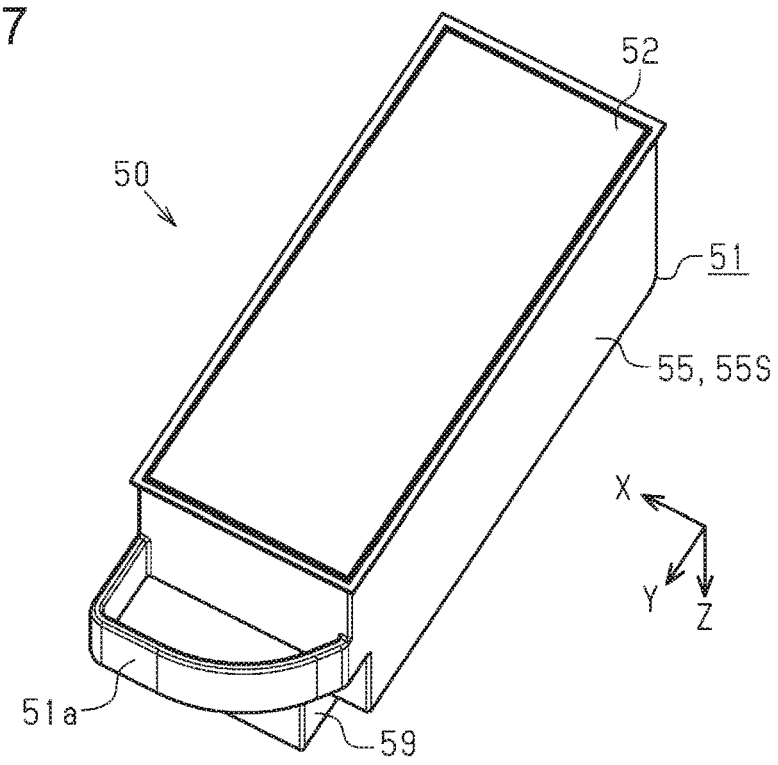
FIG. 7 is a perspective view of the waste liquid container of FIG. 5.
Figure 8:
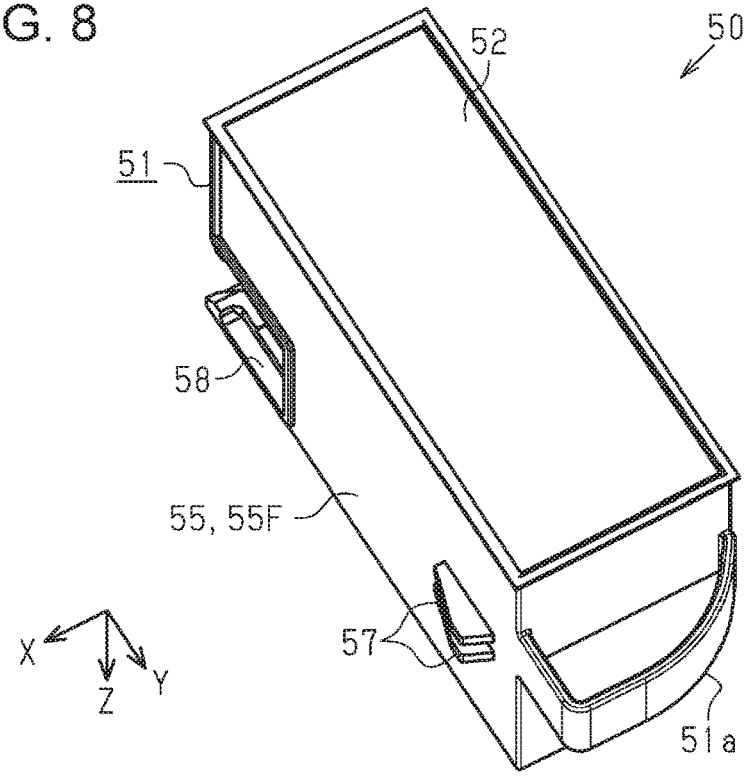
FIG. 8 is a perspective view of the waste liquid container in FIG. 5.

As illustrated in FIG. 3 and FIG. 4, the mounting portion 40 includes a discharging portion 41 (refer to FIG. 3) that discharges the waste liquid by passing through the discharging tube 35 (refer to FIG. 2), a locking portion 42, and a projecting portion 44 in which a substrate connecting portion 43 is mounted.

The locking portion 42 is constituted by, for example, a plate spring locking the waste liquid container 50 inserted into the mounting chamber 18. The substrate connecting portion 43 is electrically connected to the controller 100 (refer to FIG. 2). In addition, the projecting portion 44 includes a pair of guide projection portions 44*a* projecting upward and downward.

As illustrated in FIG. 3, in the mounting portion 40, the discharging portion 41 is disposed further upward than the substrate connecting portion 43. Inside the mounting chamber 18, in a side lower than the discharging portion 41, a step portion 49 extending in the mounting direction toward the inside from the vicinity of an opening of the mounting chamber 18 may be provided. In addition, in the mounting chamber 18, it is preferable that, in the width direction in a case in which a direction in the moving direction X is set to a width direction, the discharging portion 41 and the step portion 49 be disposed on the home side (right side in FIG. 3), further than a predetermined reference position (for example, center), and the locking portion 42 and the projecting portion 44 be disposed on the opposite home side (left side in FIG. 3), further than the reference position in the width direction.

Next, embodiments of the waste liquid container 50 will be described with reference to the drawings.

As illustrated in FIG. 4, the waste liquid container 50 includes an accommodating case 51, which has a box-shaped bottom, in which a side, which becomes an upper portion when mounted to the mounting portion 40, opens, and a lid member 52 covering an opening of the accommodating case 51.

As illustrated in FIG. 5 to FIG. 8, the waste liquid container 50 has a substantially rectangular shape where the mounting direction (transporting direction Y) becomes the longitudinal direction. The accommodating case 51 includes a handle portion 51*a* on an end portion of a front side in the mounting direction. At the time of attaching and detaching the waste liquid container 50 to and from the mounting portion 40 (refer to FIG. 4), a user places their hand on the handle portion 51*a*, the waste liquid container 50 can be inserted into the mounting chamber 18 (refer to FIG. 4) or taken out from the mounting chamber 18.

Figure 9:
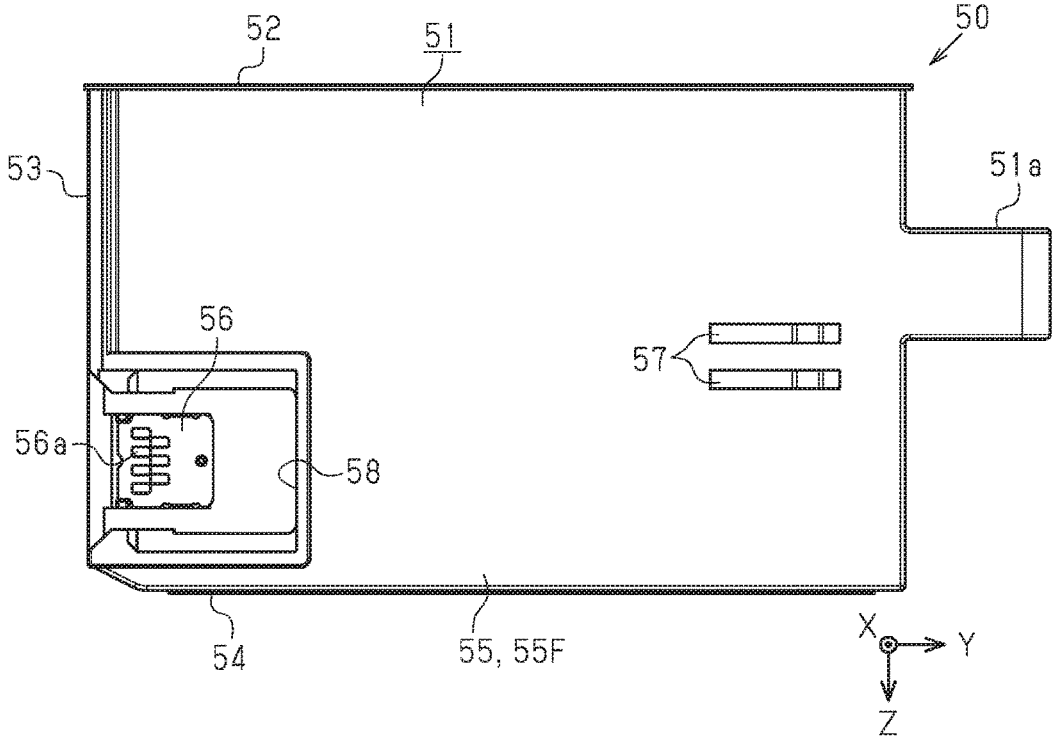
FIG. 9 is a side view of one side of the waste liquid container in FIG. 5.
Figure 10:
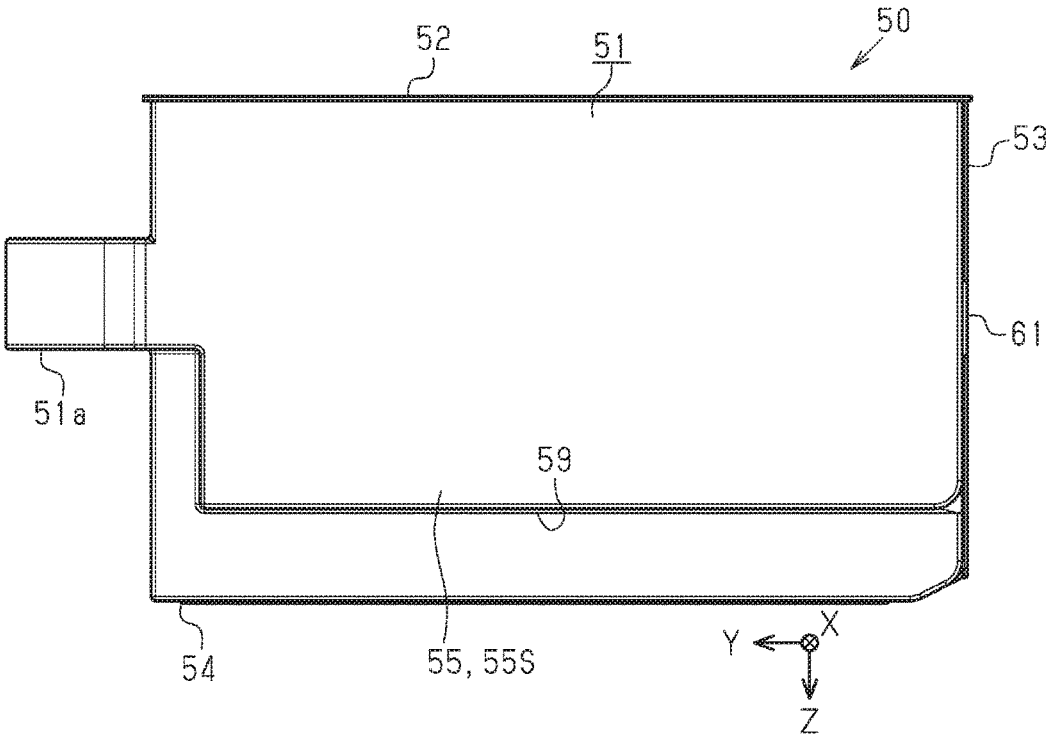
FIG. 10 is a side view of the other side of the waste liquid container in FIG. 5.
Figure 11:
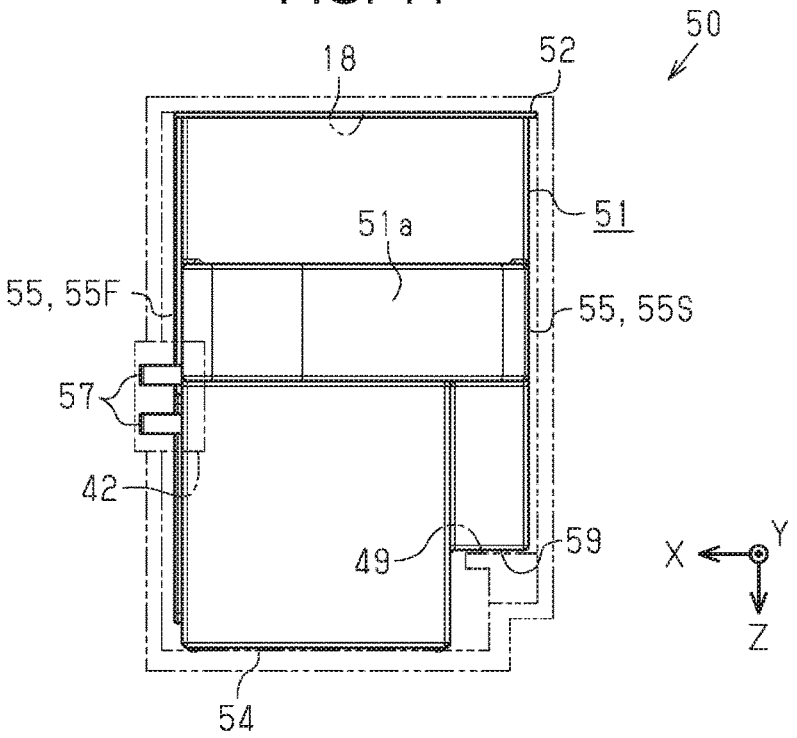
FIG. 11 is a rear view of the waste liquid container in FIG. 5.

As illustrated in FIG. 9 to FIG. 11, when a direction intersecting both of the gravity direction Z and the mounting direction is set to a width direction (direction along moving direction X), the accommodating case 51 includes a mounting surface 53 which is an outside surface present inside in the mounting direction, a bottom surface 54 which becomes a lower surface at the time of mounting, and a pair of side surfaces 55 (first side surface 55F and second side surface 55S) which is an outside surface extending in a direction intersecting the width direction.

As illustrated in FIG. 9, the waste liquid container 50 is provided with a circuit board 56 including a connecting terminal 56*a* electrically connected to the substrate connecting portion 43 (refer to FIG. 4), at the time of being mounted on the mounting portion 40 (refer to FIG. 4). In the circuit board 56, information of an amount of containing of the waste liquid container 50, and the like is stored. In addition, in the first side surface 55F of the accommodating case 51, a engaging projection portion 57 which is engaged to the locking portion 42 (refer to FIG. 4) in a case of being inserted to the mounting chamber 18 (refer to FIG. 4) is projected.

Figure 12:
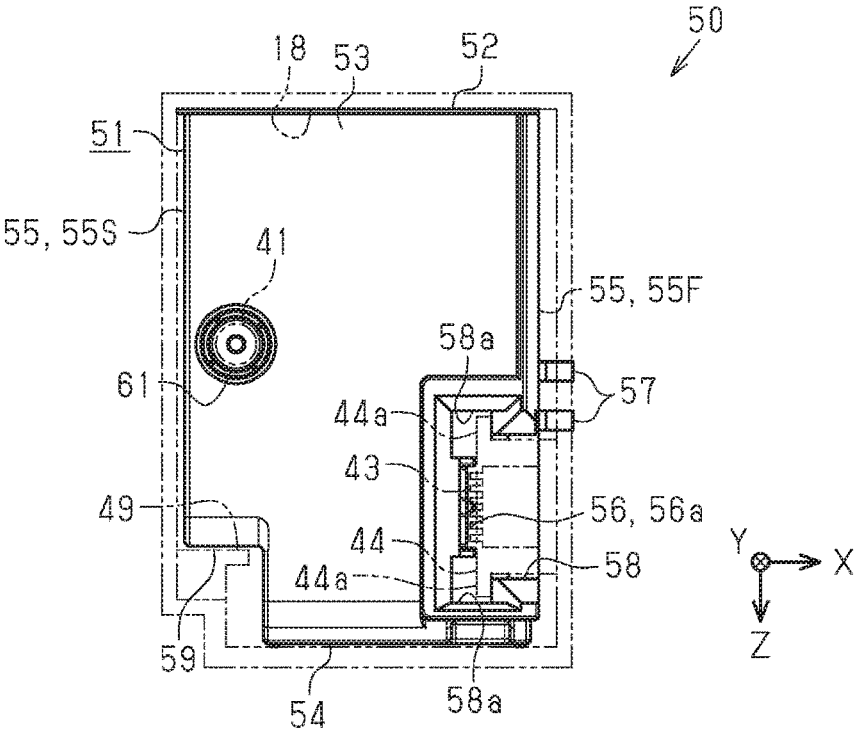
FIG. 12 is a front view of the waste liquid container in FIG. 5.

As illustrated in FIG. 12, the waste liquid container 50 is provided with a waste liquid introducing portion 61 connected to the discharging portion 41 at the time of being mounted on the mounting portion 40. The accommodating case 51 includes a recessed portion 58 which allows the projecting portion 44 to be inserted, which opens on the mounting surface 53 and the first side surface 55F, at the time of being mounted on the mounting portion 40, and a notch 59 which opens on at least the mounting surface 53 and the second side surface 55S vertically below the waste liquid introducing portion 61.

In the accommodating case 51, it is preferable that the notch 59 be provided right below the waste liquid introducing portion 61. In addition, in the accommodating case 51, it is preferable that the recessed portion 58 be provided between a predetermined reference position (for example, center) and the first side surface 55F in the width direction, and the waste liquid introducing portion 61 and the notch 59 are provided between the reference position described above and the second side surface 55S in the width direction. Also, the reference position of this case may be corresponded to a reference position when the discharging portion 41 and the projecting portion 44 are disposed in the mounting chamber 18.

The circuit board 56 is disposed inside the recessed portion 58 with the connecting terminal 56*a*. In addition, in the recessed portion 58, a guiding groove 58*a* which can be engaged with the guide projection portion 44*a* of the projecting portion 44 is recessed and provided on an upper side and a lower side of the circuit board 56.

It is preferable that the circuit board 56 be mounted in the accommodating case 51 so that the connecting terminal 56*a* is disposed toward the outside in the width direction inside the recessed portion 58. In addition, it is preferable that the notch 59 be formed to extend from the mounting surface 53 in the unmounting direction.

Next, attaching and detaching operation with respect to the mounting portion 40 of the waste liquid container 50 and action of the waste liquid container 50 will be described.

When the waste liquid container 50 is moved in the mounting direction with respect to the mounting portion 40, the locking portion 42 is engaged with the engaging projection portion 57, and movement in the unmounting direction of the waste liquid container 50 is suppressed. In addition, the discharging portion 41 is connected to the waste liquid introducing portion 61 of the waste liquid container 50 by movement in the mounting direction of the waste liquid container 50, the connecting terminal 56*a* of the circuit board 56 comes into contact with the substrate connecting portion 43, and the circuit board 56 and the controller 100 (refer to FIG. 2) are electrically connected to each other. At this time, when the guide projection portion 44*a* of the projecting portion 44 is engaged with the guiding groove 58*a* of the waste liquid container 50, the connecting terminal 56*a* of the circuit board 56 is accurately positioned with respect to the substrate connecting portion 43.

The controller 100 detects that the waste liquid container 50 is mounted, by being electrically connected to the circuit board 56, and reads information stored in the circuit board 56. Also, in a case in which a vacancy is present in the amount of containing of the waste liquid container 50, introducing the waste liquid to the waste liquid container 50 is allowed.

Accordingly, when a maintenance operation such as cleaning in the liquid ejecting apparatus 11 is performed, the waste liquid discharged from the liquid ejecting head 21 is introduced to the waste liquid container 50 through the discharging portion 41 and the waste liquid introducing portion 61. The controller 100 subtracts an amount of the discharged waste liquid from the amount of containing of the stored waste liquid container 50, if an amount of discharging of the waste liquid is close by the amount of containing, the controller informs a command that the waste liquid container 50 is need to be exchanged through a panel 16, and the like.

However, Although an amount of absorbing of the absorber 50*a* contained in the waste liquid container 50 is remained, for example, in a case in which the waste liquid is solidified near the waste liquid introducing portion 61 inside the waste liquid container 50, or the like, the waste liquid discharged from the discharging portion 41 over-flows from the waste liquid container 50. When the leaked waste liquid as described above is attached to the connecting terminal 56*a* or the substrate connecting portion 43, electrical connection of both is inhibited, and there is a concern that information cannot be accepted.

In this point, since the waste liquid container 50 of the embodiment includes the notch 59 which opens on the mounting surface 53 vertically below the waste liquid introducing portion 61, when the waste liquid leaked from a vicinity of the waste liquid introducing portion 61 opening on the mounting surface 53 hangs and drips along the mounting surface 53 in a downward direction, the waste liquid enters into the notch 59 and flows along the notch 59 intersecting the mounting surface 53 in the unmounting direction. Since the notch 59 opens on the second side surface 55S and the bottom surface 54, when the waste liquid flows from the notch 59, it flows to a side of the home side of the waste liquid container 50 or a bottom portion of the waste liquid container 50.

With respect to that, since the circuit board 56 including the connecting terminal 56*a* is accommodated in the recessed portion 58 opening on the first side surface 55F of the opposite home side of the waste liquid container 50, even when the waste liquid flows to a side of the home side of the waste liquid container 50 or a lower side of the waste liquid container 50, the waste liquid is less likely to enter into the recessed portion 58. Therefore, when the circuit board 56 is accommodated inside the recessed portion 58, attaching of the leaked waste liquid to the connecting terminal 56*a* of the circuit board 56 is suppressed.

According to the embodiment, effects as follows can be obtained.

(1) Since the connecting terminal 56*a* of the waste liquid container 50 is disposed inside the recessed portion 58 opening in a direction intersecting the gravity direction Z, the waste liquid hanging and dripping further than the connecting terminal 56*a* disposed on a position in which an upper side opens is less likely to be attached, and also, the waste liquid dripping lower than the connecting terminal 56*a* disposed on a position in which a lower side opens is less likely to be attached. Further, in the accommodating case 51, since the notch 59 opening on the mounting surface 53 and the second side surface 55S is provided vertically below the waste liquid introducing portion 61, the waste liquid, which is leaked from the waste liquid introducing portion 61 and dripping from the mounting surface 53, flows to a side of the notch 59. Since the recessed portion 58 and the notch 59 open to an outside surface of an opposite side in the width direction, the waste liquid flowing the notch 59 is less likely to be flowing into the recessed portion 58. Therefore, when the notch 59 is disposed on a lower side than the waste liquid introducing portion 61, and the leaked waste liquid is guided to a side of the notch 59, attaching of the waste liquid with respect to the connecting terminal 56*a* of the circuit board 56 inside the recessed portion 58 can be suppressed.

(2) Since the circuit board 56 is mounted on the accommodating case 51 so that the connecting terminal 56*a* is disposed toward in the width direction in the recessed portion 58, attaching of the waste liquid hanging and dripping to the connecting terminal 56*a* can be suppressed, better than in a case in which the circuit board 56 is disposed so that the connecting terminal 56*a* is disposed upward. In addition, better than in a case in which the circuit board 56 is disposed so that the connecting terminal 56*a* is disposed in the downward direction, attaching of the waste liquid dripping down to the connecting terminal 56*a* can be suppressed.

(3) The notch 59 extends from the mounting surface 53 in the unmounting direction, and the waste liquid dripping from the mounting surface 53 is guided so as to flow along the notch 59 toward the unmounting direction. Accordingly, the waste liquid flows from the notch 59 in a downward direction, and the waste liquid can be suppressed from flowing into the recessed portion 58 by flowing along a bottom portion of the accommodating case 51.

(4) In the accommodating case 51, since the recessed portion 58 is provided on one side of the width direction, and the notch 59 is provided on the other side of an opposite side thereof, more than a case in which the recessed portion 58 is disposed on a lower side of the notch 59, the waste liquid flowing from the notch 59 is less likely to enter into the recessed portion 58. Therefore, attaching of the waste liquid with respect to the connecting terminal 56*a* of the circuit board 56 inside the recessed portion 58 can be suppressed.

(5) In the accommodating case 51, since the notch 59 is provided right below the waste liquid introducing portion 61, the waste liquid hanging and dripping from the waste liquid introducing portion 61 can be naturally guided to a side of the notch 59.

Also, the embodiment described above may be modified like a modification example to be illustrated as follows. In addition, the embodiment described above and each modification can be arbitrarily combined.

Figure 13:
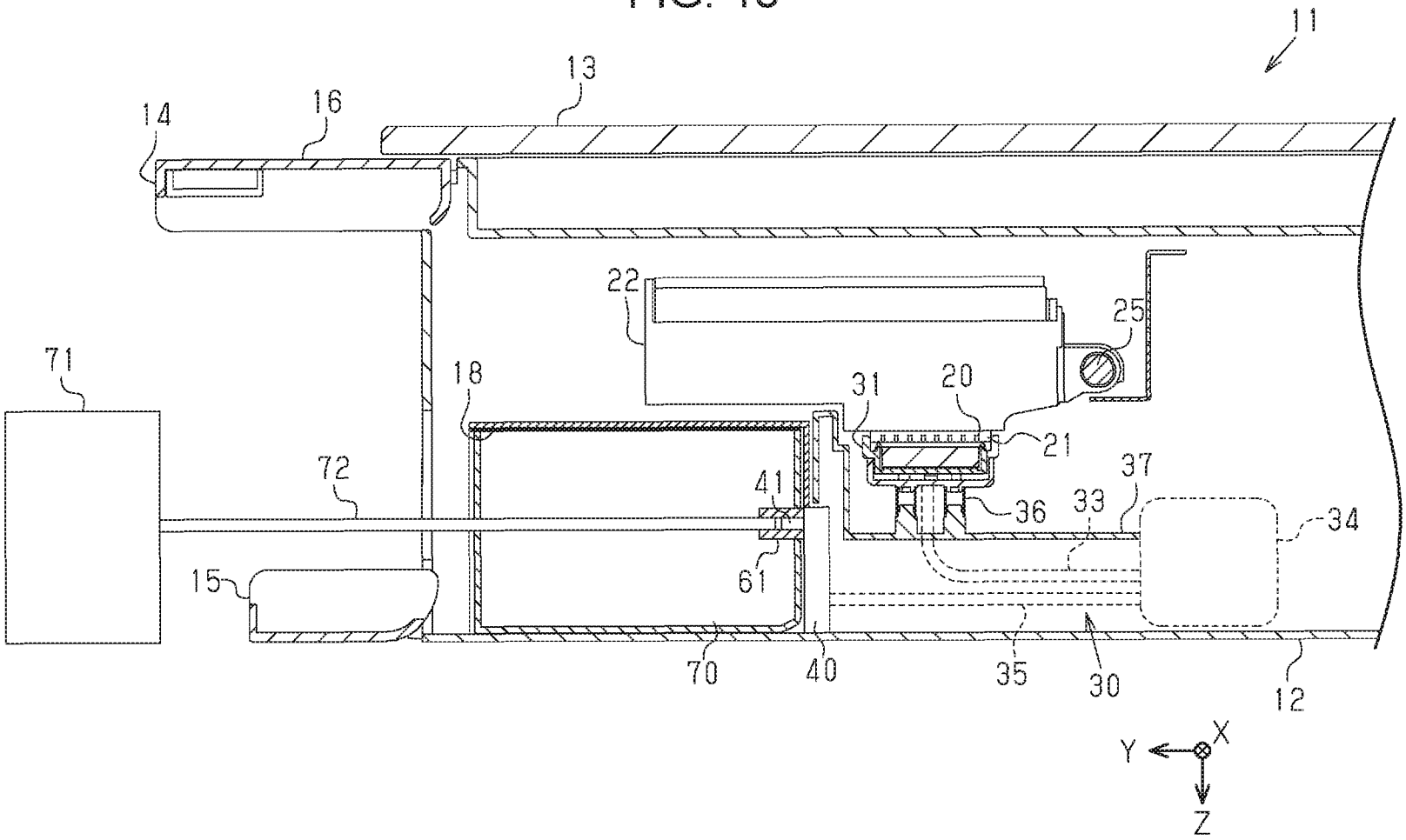
FIG. 13 is a sectional view illustrating a mounted state of an attachment of the embodiment.

As illustrated in FIG. 13, the attachment 70 may be mounted on the mounting portion 40. The attachment 70 is configured same as the waste liquid container 50, but it is different from the waste liquid container 50 in that the waste liquid is not contained therein. The attachment 70 introduces the waste liquid to the waste liquid tank 71 provided outside the case 12 through a discharging flow path 72, when the waste liquid introducing portion 61 is connected to the discharging portion 41. After the attachment 70 is mounted on the mounting portion 40, the attachment is fixed by a screw, or the like, and may not be detached from the liquid ejecting apparatus 11.

Figure 14:
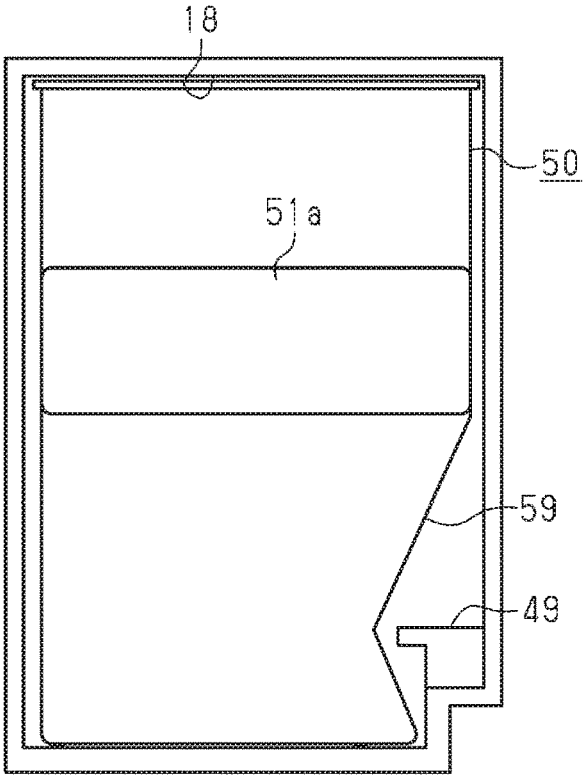
FIG. 14 is a front view illustrating a mounted state of a waste liquid container of a first modification example.
Figure 15:
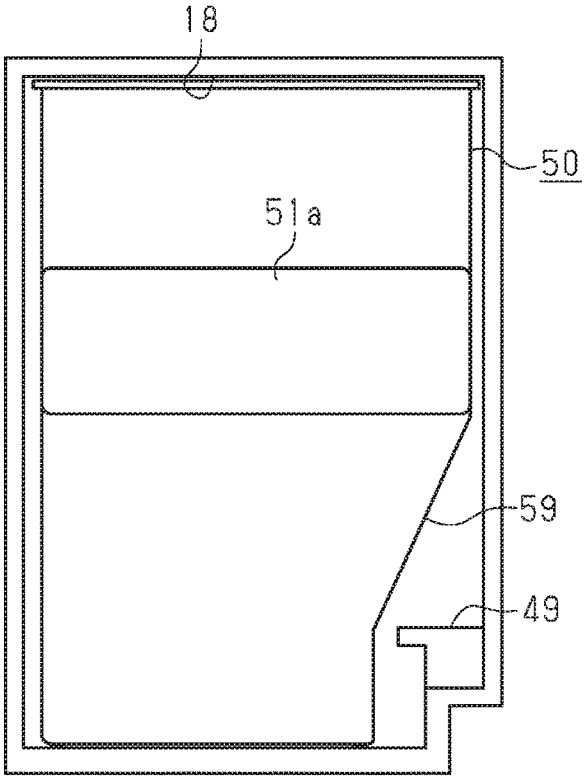
FIG. 15 is a front view illustrating a mounted state of a waste liquid container of a second modification example.
Figure 16:
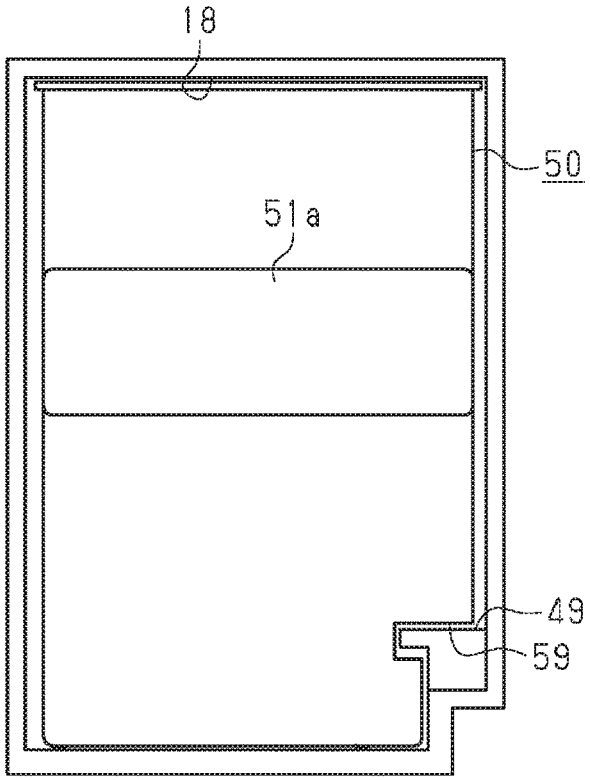
FIG. 16 is a front view illustrating a mounted state of a waste liquid container of a third modification example.

A shape of the notch 59 can be arbitrarily modified. For example, the shape of the notch 59 may be modified as a first modification example illustrated in FIG. 14, a second modification example in FIG. 15, and a third modification example illustrated in FIG. 16.

Figure 17:
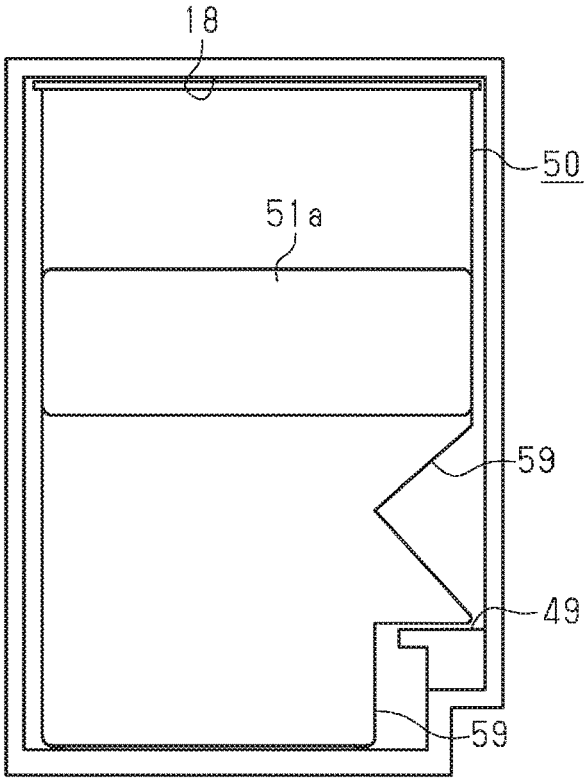
FIG. 17 is a front view illustrating a mounted state of a waste liquid container of a fourth modification example.

Disposing and the number of the notch 59 can be arbitrarily modified. For example, like a fourth modification example illustrated in FIG. 17, a fifth modification example illustrated in FIG. 18, or a sixth modification example illustrated in FIG. 19, the notch 59 may be provided in plural. In this case, shapes of a plurality of notches 59 may be different from each other.

Figure 18:
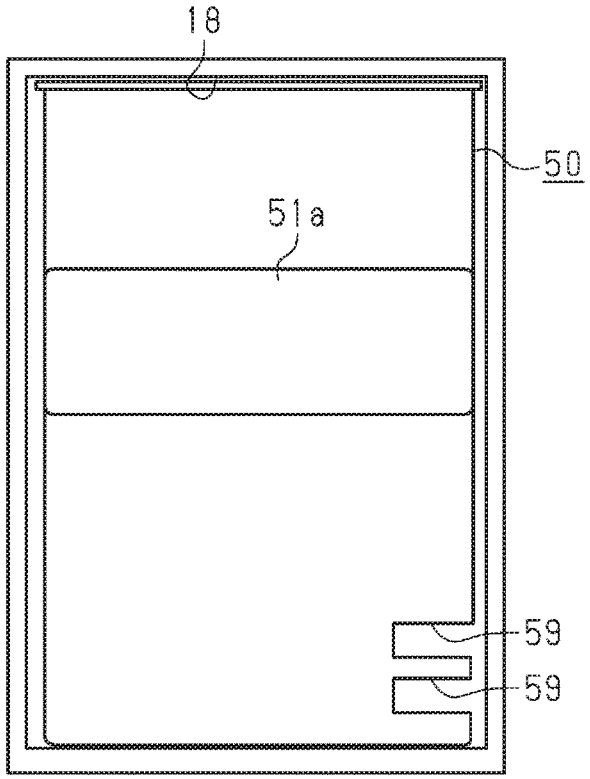
FIG. 18 is a front view illustrating a mounted state of a waste liquid container of a fifth modification example.
Figure 19:
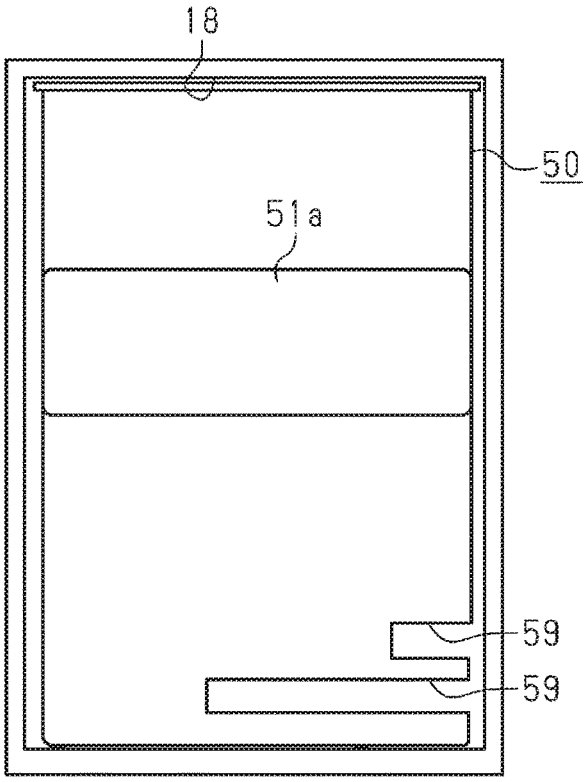
FIG. 19 is a front view illustrating a mounted state of a waste liquid container of a sixth modification example.

As illustrated in FIG. 18 and FIG. 19, the step portion 49 may not be provided on the mounting chamber 18. In this case, the notch 59 may not be need to be opened in a downward direction. According to this, the waste liquid entering into the notch 59 is less likely to hang and drip in the downward direction.

The notch 59 may not open on an outside surface of a front side of the mounting direction in the accommodating case 51.

Liquid being ejected by the liquid ejecting head 21 is not limited to ink, and for example, may be liquid of which particles of a functional material are dispersed or mixed in liquid, or the like. For example, the apparatus may be configured to perform recording by ejecting liquid of which a material such as an electrode material or a color material (pixel material) used for manufacturing a liquid crystal display, an electroluminescence (EL) display, a surface light-emission display, or the like is dispersed or dissolved.

The medium S is not limited to paper, but may be plastic film or a thin plate material, or may be a fabric used for a textile printing apparatus, or the like.

The entire disclosure of Japanese Patent Application No. 2016-005017, filed Jan. 14, 2016 is expressly incorporated by reference herein.

What is claimed is:

1. A waste liquid container which is detachably mounted in accordance with moving in a mounting direction intersecting a gravity direction, with respect to a mounting portion including a projecting portion, in which a substrate connecting portion is mounted, and a discharging portion, which discharges waste liquid, the waste liquid container comprising:

an accommodating case that includes a mounting surface which is an external surface that faces internally in the mounting direction and a first side surface and a second side surface which are outside surfaces extending in a direction intersecting a width direction, when a direction intersecting both the gravity direction and the mounting direction is set to the width direction;

a waste liquid introducing portion that is connected to the discharging portion at the time of being mounted on the mounting portion; and a circuit board that includes a connecting terminal which is electrically connected to the substrate connecting portion at the time of being mounted on the mounting portion, wherein the accommodating case includes a recessed portion which opens on both the mounting surface and the first side surface and allows the projecting portion to be inserted therein, when being mounted on the mounting portion, and a notch which opens on both the mounting surface and the second side surface vertically below the waste liquid introducing portion, and wherein the connecting terminal is disposed inside the recessed portion.

2. The waste liquid container according to claim 1, wherein the circuit board is mounted in the accommodating case so that the connecting terminal is disposed toward the outside in the width direction in the recessed portion.

3. The waste liquid container according to claim 1, wherein the waste liquid container is removed from the mounting portion in accordance with moving in a unmounting direction, which is a direction opposite to the mounting direction, wherein the accommodating case includes a front surface opposite to the mounting surface, and wherein the notch extends from the mounting surface in the unmounting direction to the front surface.

4. The waste liquid container according to claim 1, wherein, in the accommodating case, the recessed portion is provided between a reference position and the first side surface in the width direction, and the notch is provided between the reference position and the second side surface.

5. The waste liquid container according to claim 1, wherein, in the accommodating case, the notch is provided right below the waste liquid introducing portion.

6. An attachment which is mounted by moving in a mounting direction intersecting a gravity direction with respect to a mounting portion including a projecting portion, in which a substrate connecting portion is mounted, and a discharging portion, which discharges waste liquid, the attachment comprising:

an accommodating case that includes a mounting surface which is an external surface that faces internally in the mounting direction and a first side surface and a second side surface which are outside surfaces extending in a direction intersecting a width direction, when a direction intersecting both the gravity direction and the mounting direction is set to the width direction;

a waste liquid introducing portion that is connected to the discharging portion at the time of being mounted on the mounting portion; and a circuit board that includes a connecting terminal which is electrically connected to the substrate connecting portion at the time of being mounted on the mounting portion, wherein the accommodating case includes a recessed portion which opens on both the mounting surface and the first side surface and allows the projecting portion to be inserted therein, when being mounted on the mounting portion, and a notch which opens on both the mounting surface and the second side surface vertically below the waste liquid introducing portion, and wherein the connecting terminal is disposed inside the recessed portion.

* * * * *